US006651268B1

(12) United States Patent
Briggs

(10) Patent No.: US 6,651,268 B1
(45) Date of Patent: Nov. 25, 2003

(54) INTERACTIVE WAVE POOL

(76) Inventor: Rick A. Briggs, 64 Maple Grove, Springfield, IL (US) 62707

( * ) Notice: Subject to any disclaimer, the term of this patent is extended or adjusted under 35 U.S.C. 154(b) by 237 days.

(21) Appl. No.: 09/708,901

(22) Filed: Nov. 8, 2000

Related U.S. Application Data

(60) Provisional application No. 60/184,549, filed on Feb. 24, 2000.

(51) Int. Cl.[7] ..... A47K 3/10
(52) U.S. Cl. ..... 4/491; 4/496
(58) Field of Search ..... 4/491, 496; 472/128

(56) References Cited

U.S. PATENT DOCUMENTS 3,210,077 A 10/1965 Hjelte
3,509,584 A * 5/1970 Sable ..... 472/128
3,629,877 A * 12/1971 Schuster et al. ..... 4/491
D330,579 S 10/1992 Briggs
5,194,048 A 3/1993 Briggs
5,271,692 A 12/1993 Lochtefeld
5,378,197 A 1/1995 Briggs
5,421,782 A 6/1995 Lochtefeld
5,453,054 A 9/1995 Langford
5,503,597 A 4/1996 Lochtefeld
6,120,211 A 9/2000 Raike

* cited by examiner

*Primary Examiner*—Charles E. Phillips
(74) *Attorney, Agent, or Firm*—Jonathan A. Barney

(57) ABSTRACT

There is disclosed a wave pool consisting of a pool with a wave generator at the deep end, which creates waves that advance toward the shallow end. One or more interactive waterplay elements, such as water guns, pourspouts, or playsinks, are provided near the pool. Pool guests can operate these waterplay elements to selectively direct water or other play media at other guests, or into the pool itself.

28 Claims, 12 Drawing Sheets

INTERACTIVE WAVE POOL

RELATED APPLICATIONS

This application claims the benefit of U.S. Provisional Application no. 60/184,549, filed Feb. 24, 2000, titled INTERACTIVE WAVE POOL, the entirety of which is hereby incorporated by reference herein.

BACKGROUND OF THE INVENTION

1. Field of the Invention

The present invention relates to recreational wave pools and, in particular, to recreational wave pools incorporating interactive waterplay elements, such as water guns, pourspouts and playsinks, for entertaining and educating children and adults.

2. Description of the Related Art

Over the past several decades, there has been a proliferation of amusement parks, family fun centers and related commercial play structures and rides designed to meet the recreational needs of young families. Such amusement facilities can often provide a safe and exciting alternative to more traditional parks and playgrounds.

One type of family amusement facility which is gaining in popularity is the "wave pool," which simulates an oceanside beach by providing an in-ground concrete pool with a wave generator device at the deep end. When activated, the wave generator creates waves in the pool which propagate toward the shallow end. The pool guests can then play in the waves as they would play in the surf at a beach. Typically, the wave generator is activated only in defined intervals of 10 or 15 minutes, alternating with rest periods of similar duration.

Most conventional wave pools are "passive," in that they do not allow the guests to control any aspect of the pool or wave generation. This is especially true during those periods when the wave generator is inactive, making the wave pool little different than a standard in-ground pool. While a passive wave pool can be entertaining, it does not generally stimulate the development of creative thinking or problem solving abilities. It is preferred to provide a play environment that is "active" or "interactive" in order to allow play participants to operate and control any one of a number of play elements while observing and learning about the associated causes and effects.

For example, my U.S. Pat. No. 5,194,048 and related design patent D330,579 first disclosed the concept of participatory or interactive waterplay in which play participants could operate any one of a number of valves to adjust the amount of water spraying from one or more associated water effects. Play participants adjust the various valves and can immediately observe the change in the quality, rate or direction of water produced by the associated water effect. Interactive play allows play participants to experiment with and learn about various cause-and-effect reactions using any one of a number of familiar and entertaining play media, such as water, balls, balloons or the like. Small children, particularly, can benefit from the fun learning experiences garnered from such interactive play activities.

My U.S. Pat. No. 5,378,197 disclosed the concept of an interactive water ride in the form of a waterslide. The water ride includes a waterslide portion comprising an inclined chute or channel upon which ride participants slide down. An adjacent stairway is provided to allow access to the top of the waterslide. Various water forming devices are positioned along the stairway and over the slide portion to allow persons climbing the stairs or waiting in line to expel water onto those sliding down the slide. In this manner, a water ride is provided facilitating interactive play.

SUMMARY OF THE INVENTION

One aspect of the invention is an interactive wave pool which allows guests to participate actively in the creation and direction of waves and/or various associated waterplay effects.

Another aspect of the invention is a wave pool equipped with various waterplay elements by which play participants can spray, spill, dump, or direct water or other play media into a general area or at other play participants.

In accordance with one preferred embodiment an interactive wave pool comprises a body of water having a first end and a second end, and a wave generator at the first end of the body of water. One or more play elements are located near the body of water and are operable by a first play participant to direct play media at a target.

In accordance with another preferred embodiment an interactive wave pool comprises a pool having a deep end, a shallow end, and a bottom that slopes upward from the deep end toward the shallow end. A wave generator is situated at the deep end, and one or more interactive waterplay elements are located within range of the body of water.

In accordance with still another preferred embodiment a method of facilitating interactive play comprises providing a pool and a surrounding play area that are occupiable by a first group of play participants. The method further comprises placing a wave generator in operative association with the pool, and locating a number of interactive waterplay elements in the play area. The interactive waterplay elements are operable by a second group of play participants to propel play media at the first group of play participants.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Having thus summarized the general nature of the invention and its essential features and advantages, certain preferred embodiments and modifications thereof will become apparent to those skilled in the art from the detailed description herein having reference to the figures that follow, of which.

DETAILED DESCRIPTION OF THE PREFERRED EMBODIMENT

Figure 1:
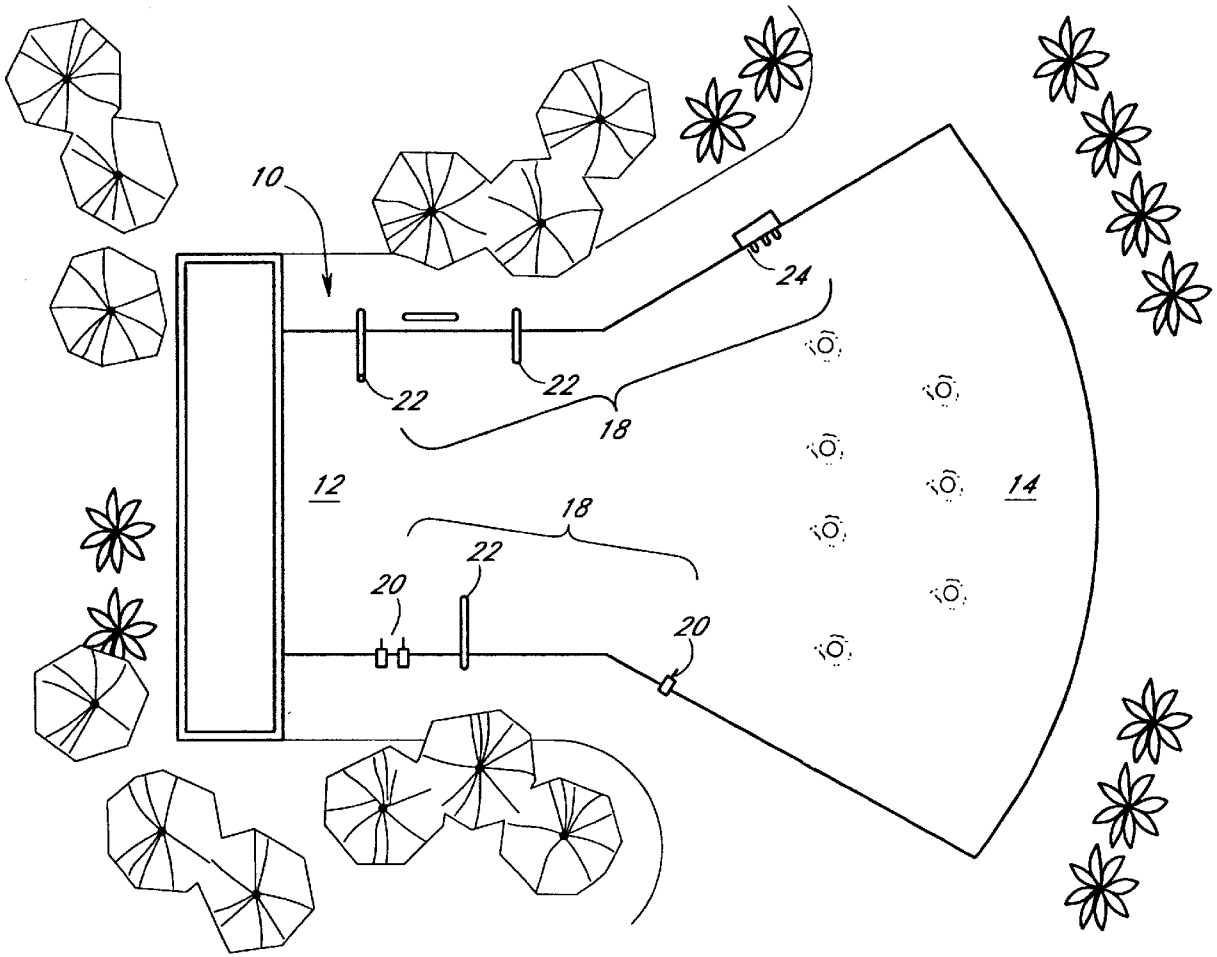
FIG. 1 is a plan view of one embodiment of an interactive wave pool in accordance with the present invention.

FIG. 1 shows one embodiment of an interactive wave pool 10 in accordance with the present invention situated within a larger interactive water park. The interactive wave pool 10 is an in-ground body of water with a deep end 12, a fan-shaped shallow end 14, and a wave generator 16 located at the deep end 12. Toward the shallow end 14, the bottom of the interactive wave pool 10 slopes generally upward to resemble the geometry of the area near the water's edge at a beach. The wave generator 16 creates waves in the pool 10 which propagate toward the shallow end 14 and form crests or white caps once they reach a sufficiently shallow portion of the pool 10.

Preferably, the wave generator 16 is activated intermittently with a 10–15 minute on interval alternating with a 10–15 minute off interval so as not to overtire the participants in the pool 10 and provide an entertainment experience which is alternately relaxing and exciting. Alternatively, the wave generator may be actuated by the play participants themselves.

A plurality of interactive waterplay elements 18 are provided alongside the pool 10 to facilitate interactive waterplay between participants in the pool 10 and/or those in the immediate surroundings. These interactive waterplay elements can include water blasters 20, pourspouts 22, or playsinks 24. However, many varieties of interactive waterplay elements are suitable for use with the interactive wave pool 10, as will be discussed in detail below. The particular interactive waterplay elements discussed herein are intended to be exemplary only, and thus serve as examples of the wide variety of play elements considered to be within the scope of the invention; namely, anything operable by a first play participant to direct play media (not only water, as will be discussed below) at a target. In one embodiment the interactive waterplay elements 18 are usable at any time to facilitate interactive play; in other embodiments they may be usable only during those intervals when the wave generator 16 is inactive.

Figure 2:
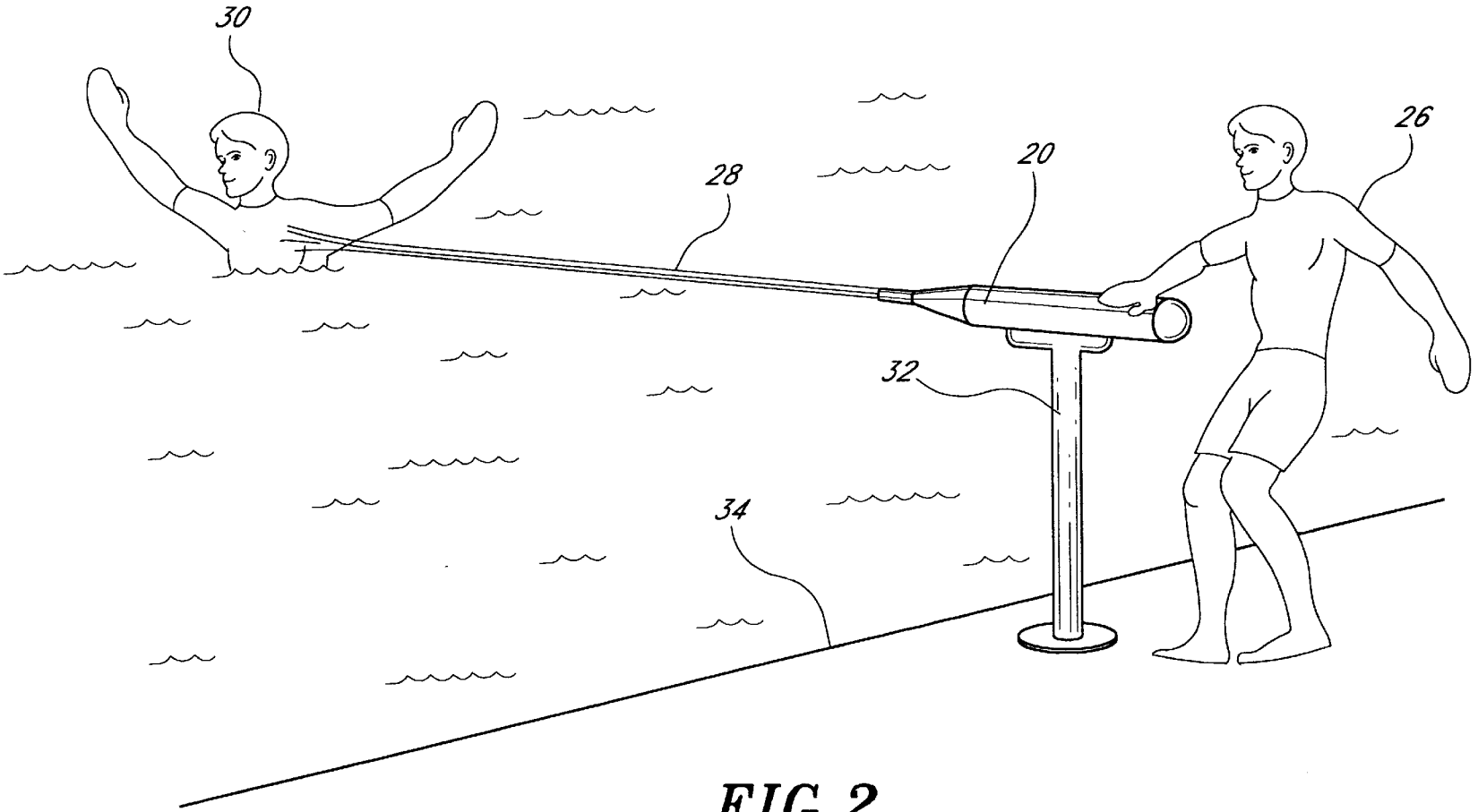
FIG. 2 is a schematic view of a water blaster for use with an interactive wave pool.

FIGS. 2–10 show different varieties of interactive waterplay elements that are suitable for use with the interactive wave pool 10. FIG. 2 shows a water blaster 20 which is usable by a first participant 26 near the side of the pool to direct a pressurized water jet 28 at a second participant 30 in the pool. A base 32 holds the water blaster 20 and may permit movement of the water blaster 20 as desired, such as rotation of the water blaster 20 about a vertical axis and/or about a horizontal axis parallel to the edge 34 of the pool, so that the first participant 26 can aim the water jet 28 as desired. In other embodiments, the water blaster 20 may be adapted to shoot play projectiles, such as foam rubber balls, tennis balls, balloons, soft plastic darts, etc., at the second participants 30 in the pool.

Figure 3:
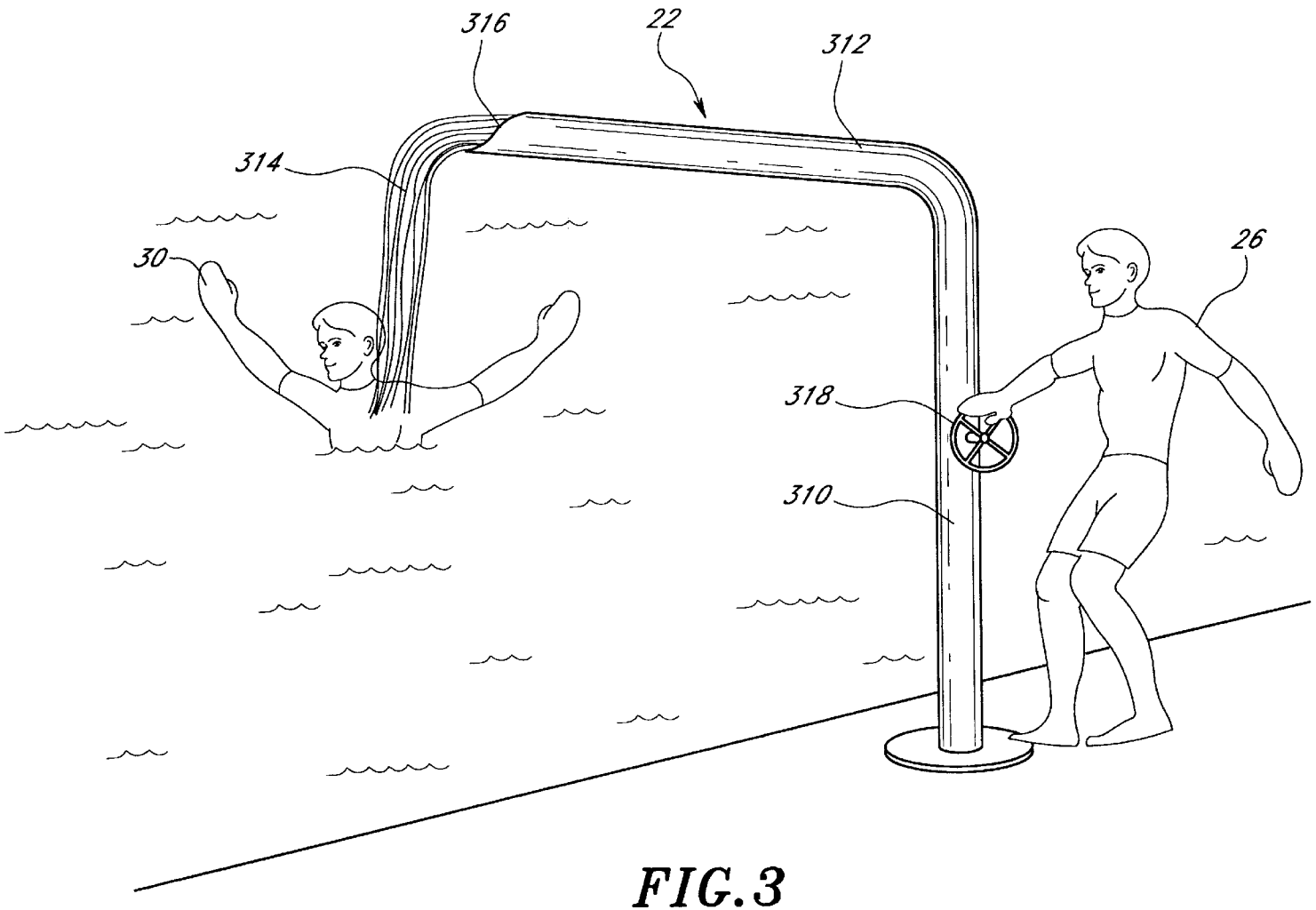
FIG. 3 is a schematic view of a pourspout for use with an interactive wave pool.

FIG. 3 shows a pourspout 22 which consists of a vertical member 310 and a horizontal member 312 extending over the water in the pool. The pourspout 22 conducts a flow of water 314 up the vertical member 310, across the horizontal member 312, and out of an opening 316. From the opening 316, the flow of water 314 falls to the surface of the water in the pool, perhaps onto a nearby second participant 30. A wheel and valve 318 or other actuating means located on or near the vertical member 310 can be used by the first participant 26 to turn on or off or adjust the volume of the flow of water 314. Thus, the first participant 26 can vary the horizontal distance which the flow of water 314 projects from the opening 316; with a heavier volume, the flow of water 314 will project a greater distance from the opening 316. By appropriately manipulating the wheel and valve 318 or other actuating means, the first participant 26 can aim the flow of water 314 over limited range to strike the desired target in the pool. To provide an additional level of control, the horizontal member 312 or the entire pour spout 22 may rotatable about a generally vertical axis located within or parallel to the vertical member 310, allowing the user to rotate the pourspout like a crane.

Figure 4:
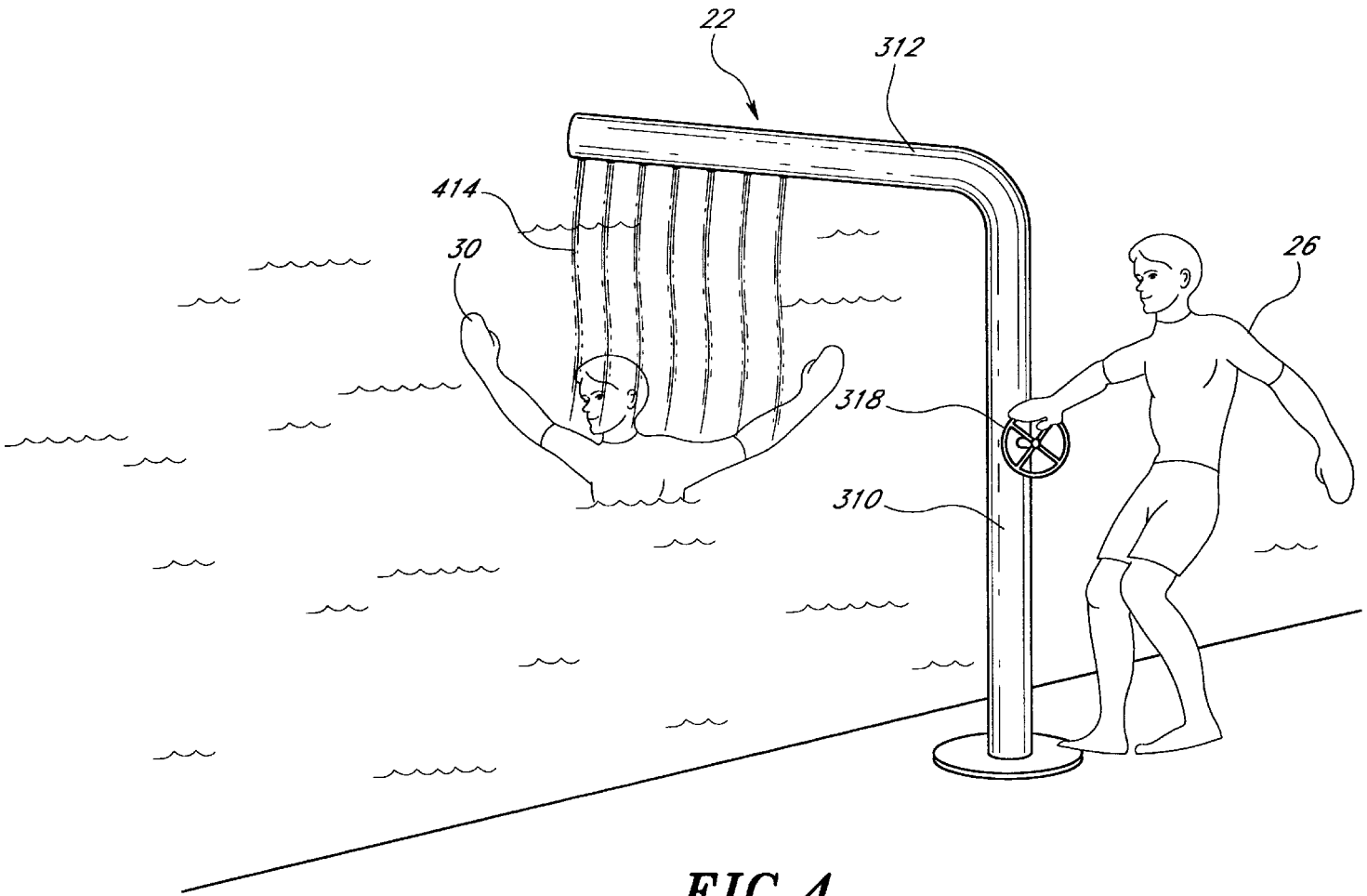
FIG. 4 is a schematic view of a second version of a pourspout for use with an interactive wave pool.

FIG. 4 shows a modified version of the pourspout 22 in which a plurality of holes 410 are situated along the horizontal member 312 so as to create a water curtain effect 414 upon manipulation of the wheel and valve 318.

Figure 5:
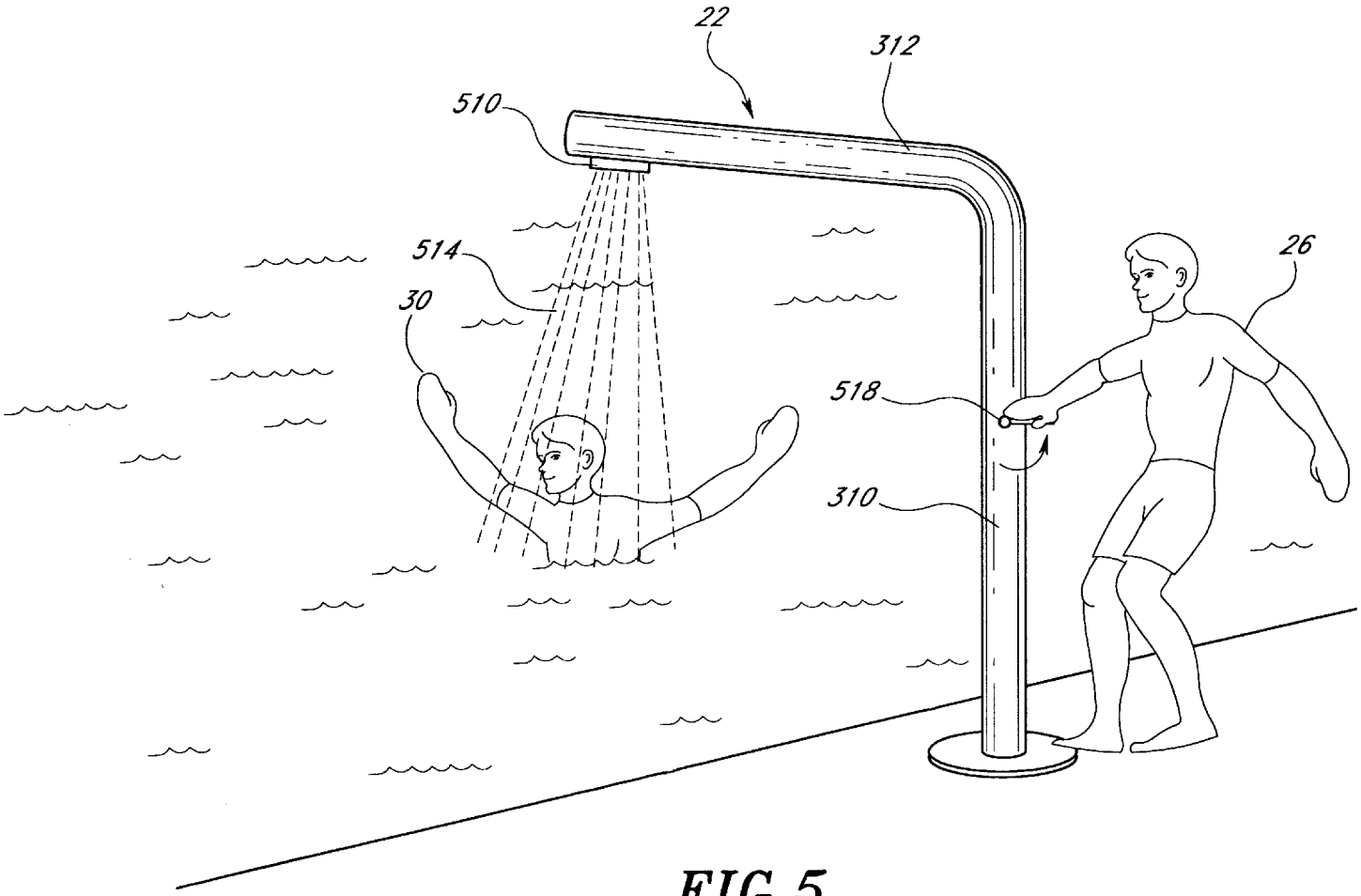
FIG. 5 is a schematic view of a third version of a pourspout for use with an interactive wave pool.

FIG. 5 shows yet another variation of the pourspout 22 in which a mist or fog sprayer 510 is located on the horizontal member 312 so as to generate a mist or fog 514 which may strike the second participant 30 upon manipulation of the lever 518 by the first participant 26. It is contemplated that the lever 518 operates a ball type valve in the pourspout 22, which provides a quicker full-open response upon rotation of the lever through 90°. This type of valve is perhaps better suited for use with the mist or fog sprayer 510, but can be used as desired with the other variations of the pourspout 22 or many of the other interactive waterplay elements described herein.

Figure 6:
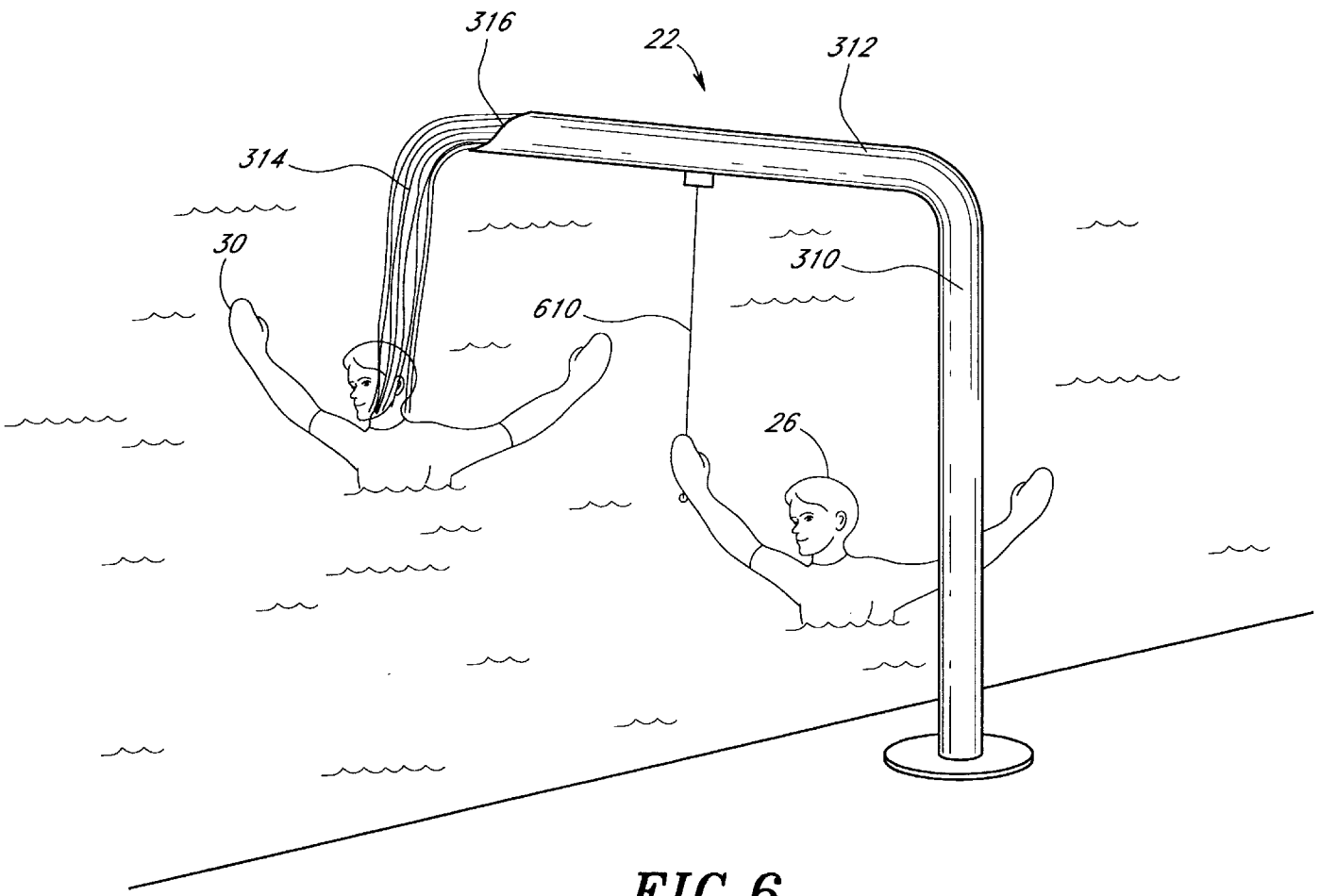
FIG. 6 is a schematic view of a fourth version of a pourspout for use with an interactive wave pool.

FIG. 6 shows another variation on the basic pourspout 22 in which a pull cord 610 is operable by a first participant 26 while standing in the pool to permit the flow of a water 314 to issue from the opening 316 in the usual manner. Naturally, one of skill in the art will appreciate that the pull cord 610 is also suitable for use with the various other versions of the pourspout 22 disclosed herein.

Figure 7:
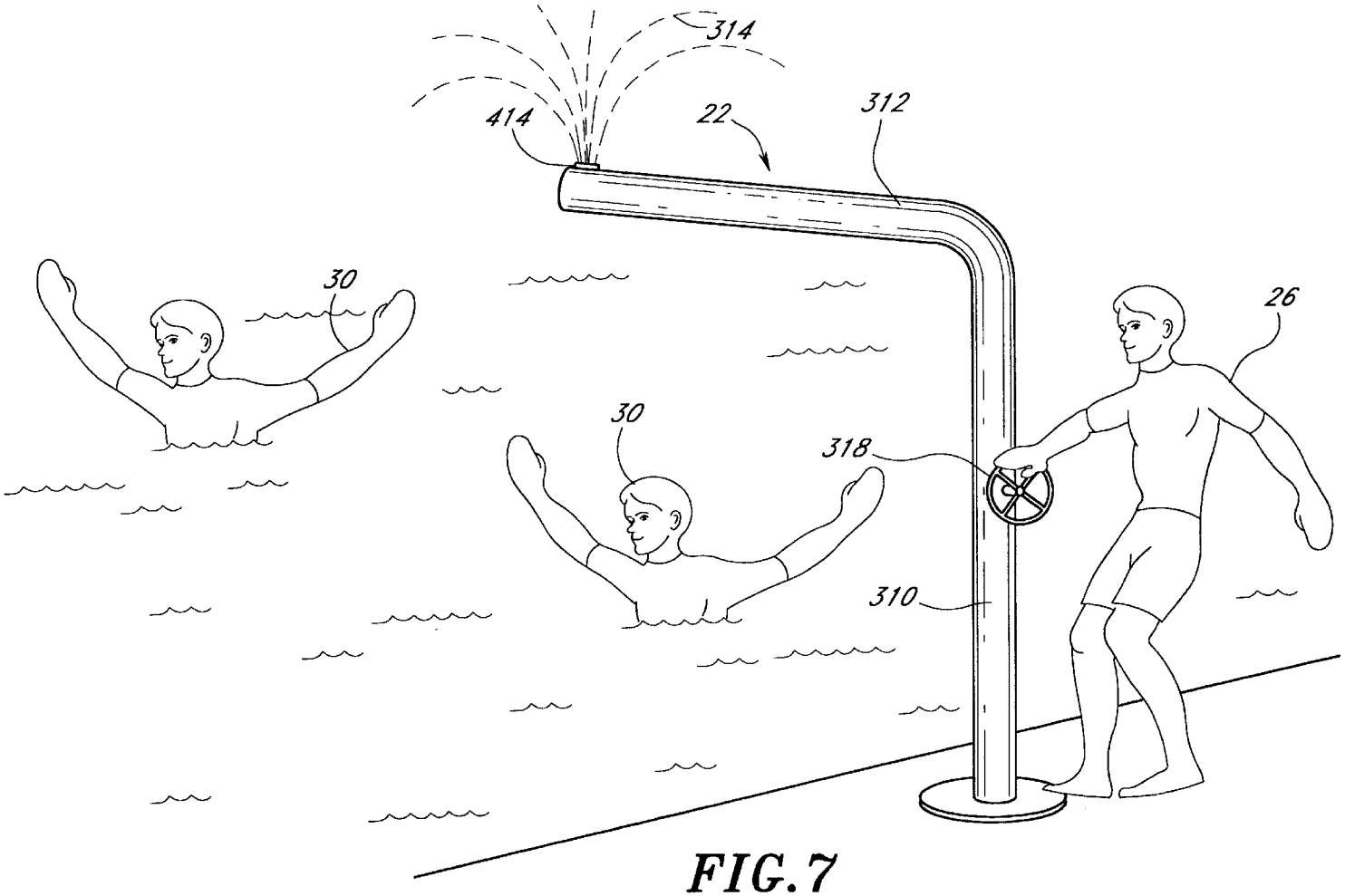
FIG. 7 is a schematic view of fifth version of a pourspout for use with an interactive wave pool.

FIG. 7 shows still another variation of the pourspout 22 in which a vertical nozzle 710 is located on the horizontal member 312. Manipulation of the wheel and valve 318 will permit a flow of water 314 of varying size to project upward from the vertical nozzle 710. The vertical nozzle 710 creates a flow of water 314 which projects over a relatively wide area compared to many of the other water forming devices described above. The vertical nozzle 710 thereby permits the first participant 26 to strike a large number of second participants 30 standing near the pourspout 22.

Figure 8:
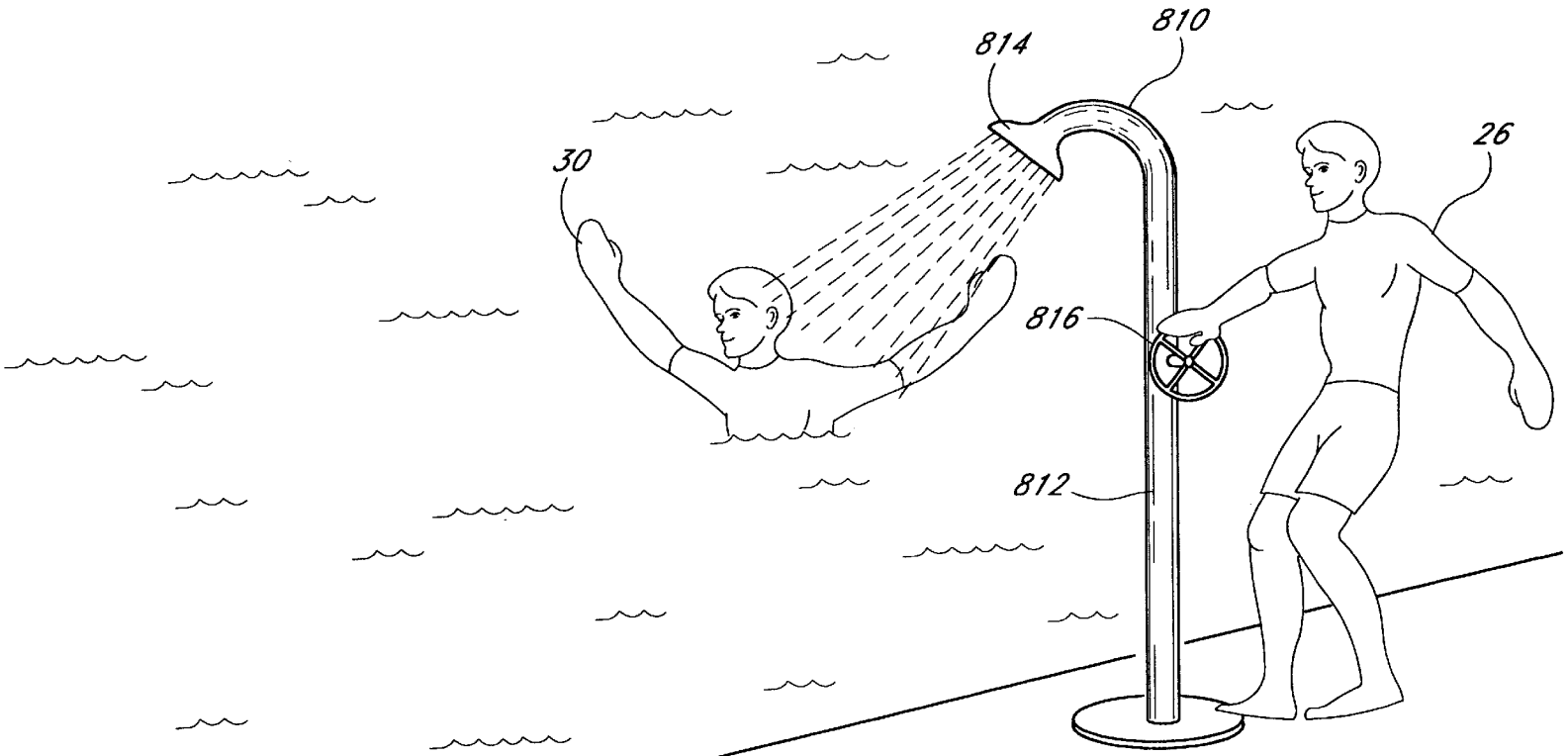
FIG. 8 is a schematic view of a shower for use with an interactive wave pool.

FIG. 8 shows another interactive waterplay element in the form of a shower 810. The shower 810 has a vertical member 812 which is suitable for carrying water up to a shower head 814. On the vertical member 812 is located a wheel and valve 816, which is operable by the first participant 26 to vary the intensity of a flow of water 818 directed at a second participant 30 in the pool.

Figure 9:
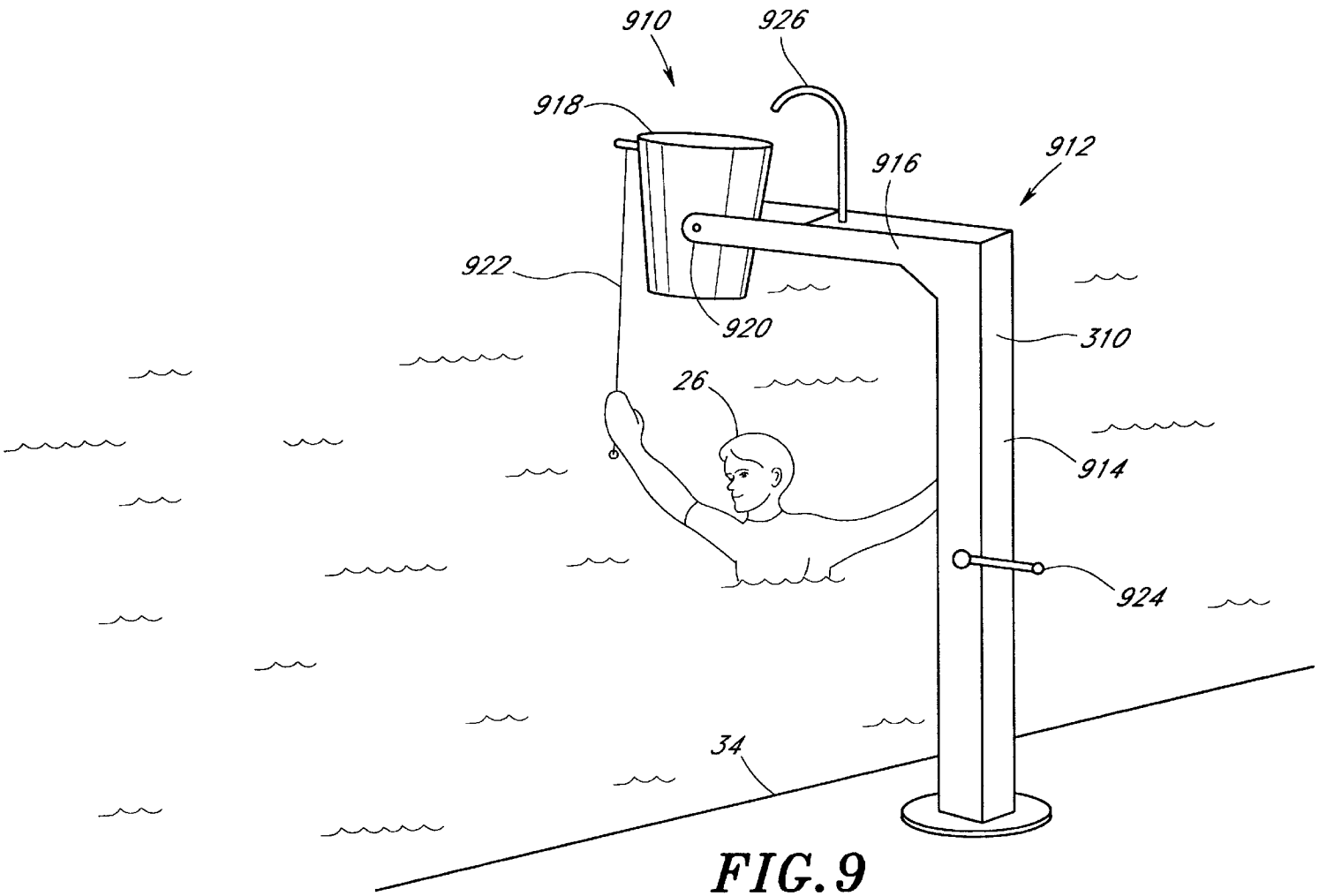
FIG. 9 is a schematic view of a bucket dump for use with an interactive wave pool.

FIG. 9 shows another interactive waterplay element in the form of a bucket dump 910. The bucket dump 910 consists of a support structure 912 having a vertical member 914 and a horizontal member 916. A bucket 918 is attached to the horizontal member 916 at a hinge point 920 so as to be rotatable about a horizontal axis parallel to the edge 34 of the pool. A rope pull 922 is attached to the bucket 918 and is operable by first participant 26 to rotate the bucket about hinge point 920 and to dump its contents onto those below. A lever and valve 924 and a spout 926 permit refilling of the bucket.

Figure 10:
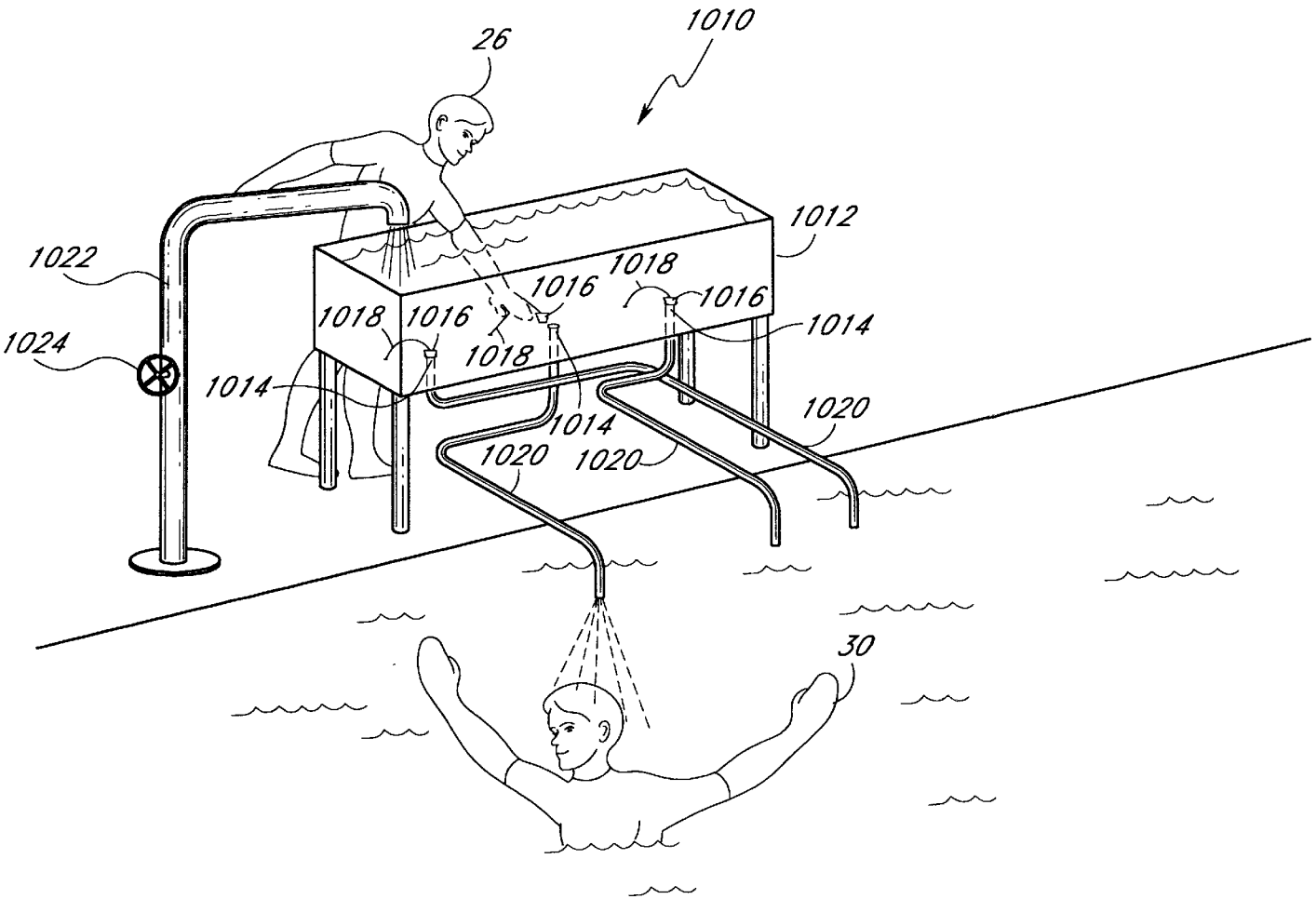
FIG. 10 is a schematic view of a playsink for use with an interactive wave pool.

FIG. 10 shows yet another interactive waterplay element in the form of a playsink 1010. The playsink 1010 consists of an elevated open top tank 1012 with a plurality of openings 1014 along its bottom. The openings 1014 receive a corresponding plurality of stoppers 1016 which are attached to the tank 1012 by lanyards 1018. Leading from the openings 1014 are a plurality of drain pipes 1020 which take a number of bends and turns as they progress away from their respective openings 1014. Thus, when the first participant 26 removes the stopper 1016 from its opening 1014 by pulling on the stopper itself or the lanyard 1018, water will flow out of the tank 1012 through the drain pipe 1020 in an entertaining manner. The tank 1012 is elevated such that water flowing from drain pipes 1020 can strike a second participant 30 standing underneath the drain pipes 1020. Water is supplied to the playsink 1010 by a vertical spout 1022 that may incorporate a valve 1024 to permit selective operation by one or more play participants.

Figure 11:
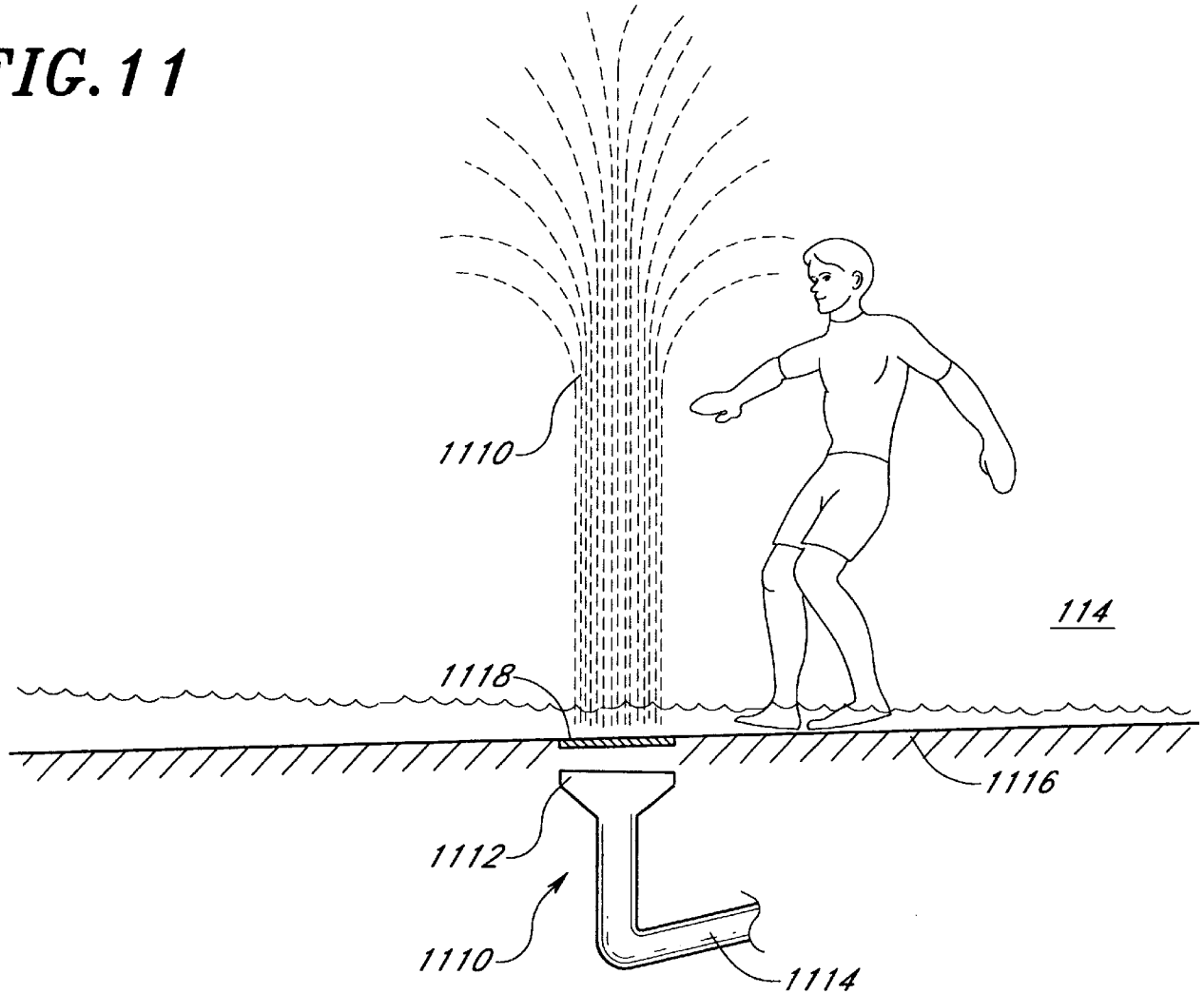
FIG. 11 is a schematic view of a geyser for use with an interactive wave pool.

FIG. 11 depicts a geyser 1110 which may be suitable for use with an interactive wave pool in accordance with the present invention. The geyser 1110 consists of a geyser nozzle 1112 connected to a water supply pipe 1114 located underneath the bottom surface 1116 of the interactive wave pool near the shallow end 14. When activated, either automatically (such as by a timer) or manually by a play participant, the geyser nozzle 1112 projects water through a grate 1118 located in the bottom surface 1116, thereby forming a vertical water spray 1120.

Figure 12:
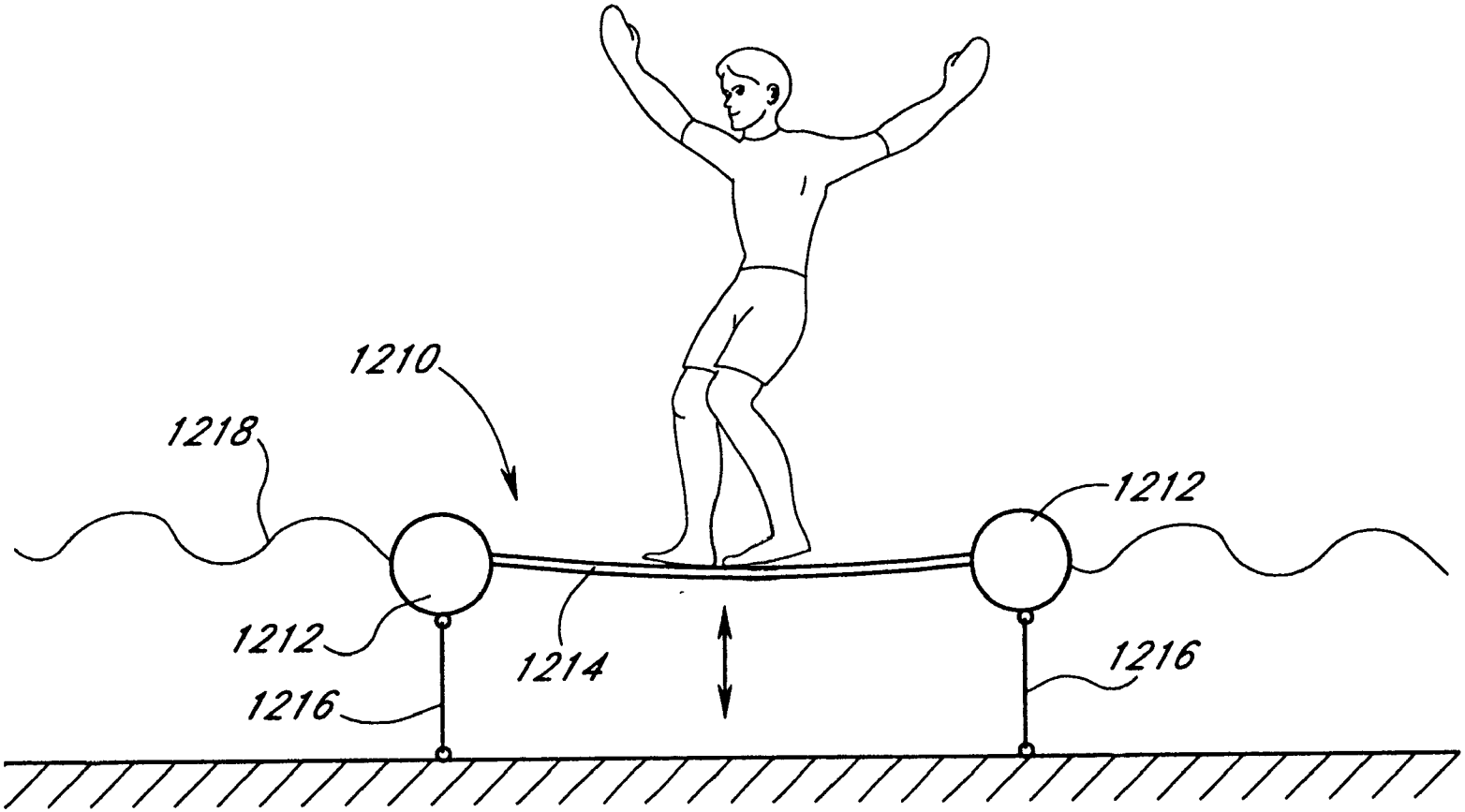
FIG. 12 is a schematic view of an interactive wave maker that may be used by one or more play participants to generate waves in the surface of a pool.

In FIG. 12 is shown an interactive wave maker 1210 that may be used by one or more play participants to generate waves in the surface of the pool, either in combination with or in place of a standard powered wave generator. The wave maker 1210 comprise one or more floats 1212 that support a generally horizontal pad 1214. The floats and pad are configured as necessary to provide buoyancy and stability; e.g. with an annular or "donut" shaped float surrounding a central pad, or with four pads located at the comers of a square or rectangular pad. A number of tethers or springs 1216 anchor the wave maker 1210 to the floor of the pool, maintaining the wave maker's position with respect to the sides of the pool. The floats may be constructed of urethane, styrofoam, or any other suitable material. The pad 1214 may advantageously comprise a strong but relatively flexible material, such as a heavy nylon or neoprene sheet, etc. A play participant stands on the pad 1214 and creates waves 1218 in the surface of the pool by jumping up and down repeatedly. Alternatively, the wave maker 1210 can be used as a simple surface for sitting, standing, reclining, or otherwise serving as a "rest area" for play participants. The wave maker 1210 may advantageously incorporate theming elements (not shown) to give the wave maker 1210 the appearance of a lily pad.

While many of the foregoing descriptions of interactive waterplay elements involve a water blaster, pourspout, shower, etc. located at ground level at the side of the pool, and used by a first play participant standing outside of the pool to direct play media at a second play participant located inside the pool, it is contemplated that certain variations are within the scope of the present invention. For example, the waterplay elements need not be located outside of the pool or at ground level;, they may be mounted within the pool to be usable by play participants inside the pool (safety considerations permitting) or on elevated platforms adjacent the pool. In addition, the target of the play media directed by the interactive waterplay elements need not be a second play participant located in the pool; the second play participant may, for example, be in the areas surrounding the pool, or in a relatively remote location perhaps near a remotely-activated waterplay element operable by a control in or near the pool. Or the target may comprise something other than a person, e.g. a bucket or other receptacle that the play participant(s) must fill with water or other play media, or a series of targets that the play participant must strike or knock down. Upon filling the bucket or striking the required targets, the play participant(s) may earn a reward, such as activation of the wave generator, or bonus time during which the generator remains on.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. Thus, it is intended that the scope of the present invention herein disclosed should not be limited by the particular disclosed embodiments described above, but should be determined only by a fair reading of the claims that follow.

What is claimed is:

1. An interactive wave pool for cooling and entertaining multiple play participants, comprising:

a body of water having at least one side and a first end and a second end, said first end being relatively deeper than said second end;

a wave generator disposed at the first end of the body of water, said wave generator being selected and adapted to create waves that propagate over said body of water from said first end toward said second end; and one or more play elements located in or near the body of water, said play elements being operable by one or more play participants to actuate said wave generator.

2. The interactive wave pool of claim 1, wherein said play elements are selected and adapted to enable a first play participant to direct water or other play media at one or more targets.

3. The interactive wave pool of claim 2, wherein at least one of said targets comprises a second play participant.

4. The interactive wave pool of claim 2, wherein said target comprises a receptacle adapted to receive said play media.

5. The interactive wave pool of claim 4, wherein said receptacle is fillable by said first play participant to receive a reward.

6. The interactive wave pool of claim 4, wherein said play media comprises play projectiles.

7. The interactive wave pool of claim 1, wherein said one or more play elements comprises at least one play element located on an elevated platform.

8. The interactive wave pool of claim 1, wherein said one or more play elements comprises at least one play element located in said body of water.

9. The interactive wave pool of claim 1, wherein said one or more play elements comprises at least one water blaster.

10. The interactive wave pool of claim 9, wherein said water blaster is selected and adapted to enable one or more play participants to direct a jet of water or other play media at one or more targets.

11. The interactive wave pool of claim 1, wherein said one or more play elements comprises at least one play element located at the side of the pool.

12. The interactive wave pool of claim 1, wherein said one or more play elements comprises at least one pourspout.

13. The interactive wave pool of claim 12, wherein said pourspout comprises a horizontal member that is capable of conducting a flow of water to an open end of said horizontal member, said open end permitting said flow of water to fall from said horizontal member.

14. The interactive wave pool of claim 12, wherein said pourspout comprises a horizontal member that is capable of conducting a flow of water to a series of openings on the underside of said horizontal member, said series of openings permitting said flow of water to fall from said horizontal member.

15. The interactive wave pool of claim 12, wherein said pourspout comprises a horizontal member that is capable of conducting a flow of water to a mist sprayer connected to said horizontal member.

16. The interactive wave pool of claim 12, wherein said pourspout comprises a horizontal member that is capable of conducting a flow of water to a generally vertical nozzle connected to said horizontal member.

17. The interactive wave pool of claim 12, wherein said pourspout further comprises a pull cord that is operable to control the flow of water within said pourspout.

18. The interactive wave pool of claim 12, wherein said pourspout further comprises a wheel that is operable to control the flow of water within said pourspout.

19. The interactive wave pool of claim 1, wherein said one or more play elements comprises at least one shower.

20. The interactive wave pool of claim 1, wherein said one or more play elements comprises at least one bucket dump.

21. The interactive wave pool of claim 1, wherein said one or more play elements comprises at least one playsink.

22. The interactive wave pool of claim 1, wherein said one or more play elements comprises at least one geyser.

23. The interactive wave pool of claim 1, further comprising at least one interactive wave maker located within said body of water.

24. An interactive wave pool for cooling and entertaining one or more play participants, comprising:

a pool having a deep end, a shallow end, and a bottom that slopes upward from said deep end toward said shallow end;

a wave generator selected and adapted to generate one or more waves capable of propagating from said deep end toward said shallow end; and one or more interactive waterplay elements located in or adjacent said body of water, said waterplay elements being selected and adapted to enable one or more play-participants to actuate said wave generator.

25. An interactive water attraction, comprising:

a body of water capable of holding one or more play participants floating and/or swimming therein;

at least one wave generator provided in operative association with said body of water for generating a propagating wave within or around said body of water;

at least one play-participant-actuated play element rotatably fixed on a pool decking and/or platform adjacent to said body of water for enabling a first play participant playing in or around said body of water to selectively aim and direct water and/or other play media at a target and/or a second play participant playing in or around said body of water;

whereby an interactive water play experience is provided.

26. The interactive water attraction of claim 25 wherein said at least one play-participant-actuated play element comprises a water blaster mounted adjacent said body of water, said water blaster being positioned and oriented so as to enable a first play participant playing in or around said body of water to direct a jet of water at a target and/or a second play participant playing in or around said body of water.

27. The interactive water attraction of claim 25 wherein said body of water comprises a pool and wherein said at least one play element is operable to enable play participants to selectively actuate said wave generator.

28. The interactive water attraction of claim 25 wherein said body of water comprises a wave pool having a relatively deep end and a relatively shallow end and wherein said wave generator generates wave that propagate from said deep end to said shallow end.

* * * * *